US007751285B1

(12) United States Patent
Cain

(10) Patent No.: US 7,751,285 B1
(45) Date of Patent: Jul. 6, 2010

(54) CUSTOMIZABLE AND WEARABLE DEVICE WITH ELECTRONIC IMAGES

(75) Inventor: John M. Cain, Edmond, OK (US)

(73) Assignee: Nano Time, LLC, Edmond, OK (US)

( * ) Notice: Subject to any disclaimer, the term of this patent is extended or adjusted under 35 U.S.C. 154(b) by 0 days.

(21) Appl. No.: 11/391,097

(22) Filed: Mar. 28, 2006

Related U.S. Application Data

(60) Provisional application No. 60/665,680, filed on Mar. 28, 2005, provisional application No. 60/693,905, filed on Jun. 24, 2005.

(51) Int. Cl.
*G04C 19/00* (2006.01)
*G04B 47/00* (2006.01)
*G04B 19/00* (2006.01)

(52) U.S. Cl. ..... 368/82; 368/10; 368/11; 368/223

(58) Field of Classification Search ..... 368/10, 368/11, 82–84, 223, 228, 239
See application file for complete search history.

(56) References Cited

U.S. PATENT DOCUMENTS 6,525,997 B1 * 2/2003 Narayanaswami et al. .. 368/223
6,714,486 B2 * 3/2004 Biggs ..... 368/82
2002/0126584 A1 * 9/2002 Wimberly ..... 368/82
2003/0193842 A1 * 10/2003 Harrison ..... 368/82
2005/0052953 A1 * 3/2005 Kent ..... 368/82

* cited by examiner

*Primary Examiner*—Vit W Miska

(57) ABSTRACT

The presently disclosed and claimed invention relates to a user personalized, wearable device that displays time along with other content in a highly customizable manner. Device personalization by the user may include 1) The ability of the user to set the device to display content, including the time, based on user-defined inputs such as time-of-day, day-of-the-year, (individual) location, special events, the seasons, and holidays; 2) The ability to display in full color various media including audio, video, animation, text, and still photographs and images; 3) The ability of the user to create and utilize his own content for displaying time; 4) Using new and unique symbolic and other representations of time; 5) Software that allows the user to select, design and change the content displayed on the device, including how the time is interlaced with the content; 6) The ability to display content not directly related to time when the user selects this option; 7) The ability to connect to a database where a supply of new content is stored; and 8) the ability to adjust all of the administrative and system settings of the device.

13 Claims, 14 Drawing Sheets

U.S. Patent Application

OVERALL FRONT OVERVIEW WITH BUTTONS

Internal Components

CONNECTIVITY OPTION

CONNECTIVITY OPTION

BUTTON CONFIGURATION

Alternate Charging Method

U.S. Patent Application

Overall device utilization process

U.S. Patent Application

PC System Administration

Setting Pre Programmed Display Sequences

U.S. Patent Application

Selecting Options to Resolve Potential Device Display Conflicts

DIGITAL TIME-NUMBERS

DIGITAL TIME-NUMBERS

ANALOG TIME

SYMBOLS TIME

SYMBOLS IN ART TIME
4:17 AND 40 SECONDS

FASHION

PICTURE WITH
SYMBOLS TIME

PICTURE WITH
DIGITAL TIME

THEME - NATURE GEM;
CUSTOMIZED ANALOG TIME

THEME - MY VACATION;
CUSTOMIZED DIGITAL TIME

SEASONAL - FIRST
DAY OF FALL

DAY-TO-NIGHT TRANSITION;
NIGHT SKY WITH MOON PHASE

SYMBOLS FOR TIME:
12:23 AM

TIME EMBEDDED INTO MOVING IMAGE

TIME - 9:10

CUSTOMIZABLE AND WEARABLE DEVICE WITH ELECTRONIC IMAGES

CROSS REFERENCE TO RELATED APPLICATIONS

This application claims the benefit under 37 C.F.R. 119(e) to U.S. Provisional applications U.S. Ser. No. 60/665,680, entitled CUSTOMIZABLE WEARABLE DEVICE WITH ELECTRONIC IMAGES, filed Mar. 28, 2005; U.S. Ser. No. 60/693,905, entitled CUSTOMIZABLE WEARABLE DEVICE WITH ELECTRONIC IMAGES, filed Jun. 24, 2005, the entire contents of which are hereby incorporated by reference in their entirety as if set forth explicitly herein.

BACKGROUND OF THE INVENTION

1. Field of Invention

The presently disclosed and claimed invention relates to a user personalized, wearable device that displays time along with other content in a highly customizable manner. Device personalization by the user may include 1) The ability of the user to set the device to display content, including the time, based on user-defined inputs such as time-of-day, day-of-the-year, (individual) location, special events, the seasons, and holidays; 2) The ability to display in full color various media including audio, video, animation, text, and still photographs and images; 3) The ability of the user to create and utilize his own content for displaying time; 4) Using new and unique symbolic and other representations of time; 5) Software that allows the user to select, design and change the content displayed on the device, including how the time is interlaced with the content; 6) The ability to display content not directly related to time when the user selects this option; 7) The ability to connect to a database where a supply of new content is stored; and 8) the ability to adjust all of the administrative and system settings of the device.

2. Description of the Related Art

Watches today, utilizing gray-scale LCD technologies, are capable of displaying basic time information such as time of day, date, day, elapsed time, and alarms. However, nothing exists today that permits users to define exactly how they would like their watches to look, and to change that look whenever they would like. Watches currently do not provide the flexibility to change the face of the watch to new designs and colors that can coordinate with a wardrobe or a particular emotion or desire, and to do so in either a pre-established or on-demand manner.

In prior art, one application discusses the application of a color blender, whereby 2 colors are animated or combined to display the time (U.S. Pat. Appl. 2003/0214885, the entire contents of which are expressly incorporated herein by reference). A second application involves changing the watch bezel to install new program elements (U.S. Pat. No. 6,238,084, the entire contents of which are expressly incorporated herein by reference). A third approach discusses downloading images to an ornament or necklace, without regard to the specifics related to the telling of time and to the prior programmability of the display sequences (U.S. Pat. Appl. No. 2004/0202052, the entire contents of which are expressly incorporated herein by reference). It references the device as something cheap, basically composed only of memory, display, and power supply (and is therefore devoid of more sophisticated processing capabilities and the ability to display real video). Several other methods apply an analog, mechanical movement super-imposed over either a simple color-changing watch face or other simple changing patterns (such as in U.S. Pat. Appl. 2003/0165086 and U.S. Pat. Appl. 2004/0145971, the entire contents of both of which are expressly incorporated herein by reference).

SUMMARY OF THE INVENTION

The concept of personalization is growing in consumer marketing. Today's consumer wants to express individuality in his purchases and lifestyles. One way this is done is through clothing and jewelry, including watches. Often a consumer will own numerous watches or pieces of jewelry that can coordinate with different wardrobes, emotions, or time of the year.

The presently disclosed and claimed invention permits the user to personalize and customize a data and fashion integrated device such as a wristwatch type of device. This customization can replace the need to have numerous watches and other articles of jewelry while adding unique functionality not found in today's products. One principle use of this device is to tell the time. However, the "art" of describing the time will be accomplished in new and unusual ways. Furthermore, the display capabilities will be used to deliver other types of content, and can include programming to display content to the wearer at a time of his or her choosing. The user will always have the choice of overriding any preprogrammed selections, selecting the look of her device from a menu of colorful dials and other content stored in the device's memory.

This new time and fashion device consists of three major components: the device that is worn; a personal computer or related device or database (including those located remotely) that can be used to store a personal library of content and images, administrative settings, and scheduling parameters; and an additional source or database consisting of a library of content that is available for the user to customize his personal device.

The wearable device is provided initially to the user with a variety of pre-stored content selections and administrative settings. The user may then choose to undertake little or no customization, or to select from among the options shipped with the device. However, many additional options exist for the user to subsequently modify and personalize his device. Consumers can literally program their wearable devices to display content by following these steps. First, they access a separate database, either via the Internet or in some other fashion, to load desired content into their personal computers (PC) or other similar consumer computer devices. Alternatively, they select desired content and store it in a secure, personal profile that is established and stored in an off-site location (such as a company's web site). They may also choose to add content of their own creation. Next, they configure that content to perform in a manner to their choosing. This may include turning on or off certain options such as sound, deciding if certain images and message content should be displayed at a specified time, and selecting content that should be stored in the personal device. The user may also establish quick access short cuts to favorite content, adjust administrative settings, and create a personalized engraved message, among other actions. Lastly, the user sends the data to the device. Once this is accomplished, users do not need to re-synchronize the device with the personal computer/database unless they wish to make significant changes to their programming or content, or if memory was insufficient to store all of the personalized content that may be desired.

There are numerous categories and types of content that can be displayed, including those synchronized to certain events or times. These include but are not limited to: a night sky after sunset; objects in the night sky; items coordinated with the time of year such as falling leaves on the first day of fall; daily messages; daily reminders; symbols that represent time; themed content (such as sports, art, nature, or religion) that include the time; and certain fashion looks or styles.

The presently claimed and disclosed wearable device may include, in one or more embodiments, one or more items chosen from the following non-exclusive list:

1. A wearable device that may be customized by a remote user.

2. A wearable device that is totally customizable by the user.

3. A level of customization that involves content covering a wide range of themes and creativity, including: different watch dials composed of different colors, shapes, digits, and symbols; unique symbolic methods of communicating time and methods of embedding time into various scenes and actions; fashion displays and colors; pictures; personal items; thematic content (such as sports, humor, or inspiration); message content (such as inspirational or motivational messages); seasonal items; holiday items; day-to-night display transformation, etc.

4. The ability of the users to create or use their own personal content for display.

5. An ability to preprogram any given content, including how time is portrayed, to appear at any given day and time. In addition, an ability to control or program how long such content will be displayed.

6. An ability to manage the device by physically interacting with the device itself or using a supplemental system such as a PC and/or the Internet.

7. An ability to create short cuts to most desired dials and content.

8. An ability to establish rules and sequences for which displays have the highest priority and to resolve possible schedule display conflicts.

9. The ability to override preprogrammed sequences or to change the current "on demand" display being shown on the wearable device by the use of buttons or a similar method to access either a new menu selection or by direct and easy access to a number of alternative time dial displays.

10. The ability to modify and adjust content in light of specific options available for a given individual content item. (For example, turning on sound, determining if time should be automatically displayed with the image, selecting the color for analog-like hands, deciding if a night sky view should appear at sunset, selecting a daily message, and determining how a given message should scroll.)

11. The ability of the device to communicate in either a wired or a wireless manner to retrieve customized content.

12. The ability to access any number of other systems and devices that have stored additional content options for the purpose of loading them into the device or compiling and storing them for later retrieval.

13. The ability to support 2-way communications, including voice-activated input.

14. The ability of the device to be recharged either wired or wirelessly. This includes but is not limited to the use of a wireless recharging pad or a docking station.

15. The ability of the wearable device to interface to either a separate charging and communication device or directly to other devices such as a personal computer, digital camera, or a storage media.

16. Unique methods of communicating time that are non obvious at first glance, including the use of symbols and content that interlaces time into the action represented by the content.

17. The ability to charge a separate fee for selected content items.

18. The ability of the user to create a personal profile of all desired content, including watch dials, pictures, themes, and fashion, along with a selection of preprogrammed sequences. This profile may be stored anywhere, including locally on a PC or remotely on an external database.

19. The existence of an upfront device designer tool that recommends and creates a customized device experience based upon unique inputs from the user.

20. A password secure area on the device for the storage of sensitive or highly personal content.

21. The ability to input and utilize location data such as latitude and longitude for computation of certain content.

22. The ability to integrate lists, reminders, and other personal text into the type of content being displayed. This includes personal calendar listings and items transferred from other devices such as a PDA, cell phone, PC, satellite, or any other communicating device.

23. The complete integration of a themed device, comprising case materials, inscriptions, straps or other fastening mechanisms, special elements and materials, and display content that all relate to a central concept.

24. A device menu structure that is customizable by the user.

25. The ability for the user to control all significant administrative aspects of the device, such as display brightness, sound, and power use settings.

26. The ability to graphically display an image tied to any and all of the concepts described herein.

27. The ability to utilize more than one display in the device and, as an option, to locate the additional display(s) in the strap or other fastening mechanism. As an option the user will have control of how and when the different displays are utilized.

28. A system that will also allow the user to change or modify content by replacing memory chips, drives, or other current storage and applications products.

29. The ability to easily interchange and replace device straps or other fastening mechanisms.

30. The option to include a more limited or no data communications product while retaining all other advances contained herein.

DETAILED DESCRIPTION OF THE INVENTION

Figure 1:
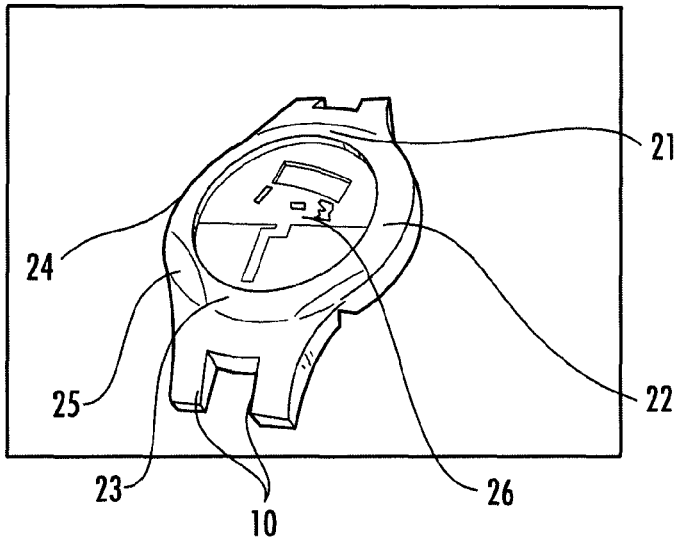
FIG. 1 shows an overall view of the device as a wristwatch based upon this invention.

Before explaining at least one embodiment of the invention in detail, it is to be understood that the invention is not limited in its application to the details of construction, experiments, exemplary data, and/or the arrangement of the components set forth in the following description or illustrated in the drawings. The invention is capable of other embodiments or of being practiced or carried out in various ways. Also, it is to be understood that the phraseology and terminology employed herein is for purpose of description and should not be regarded as limiting.

Figure 2:
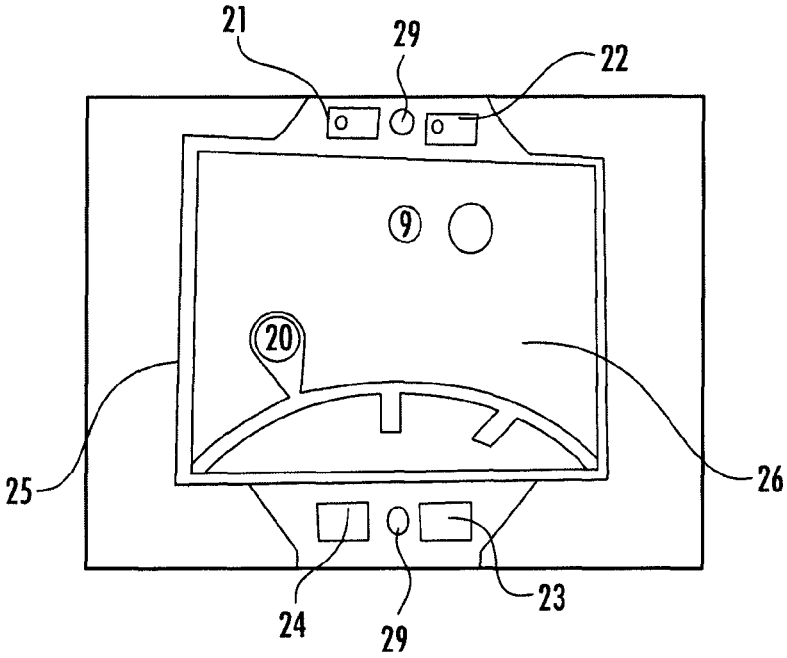
FIG. 2 shows another overall view of the device as a wristwatch based upon this invention.

Referring to FIGS. 1 and 2, two alternative device configurations are shown, most likely in this example as a wristwatch. While the cases shown are round and rectangular, any other shapes are possible, including square, oval, and more elaborate, anthropomorphic, or fancy shapes.

The internal components are enclosed in a case 24 or 25. The case may be made of any number of different materials, including but not limited to steel, gold, gold plated, platinum, aluminum, titanium, tungsten, magnesium, brass, plastic, meteorite, rock, carbon fiber, composite materials, and other such metals and manmade elements and combinations thereof. The dimensions of the case (size and shape) are predefined such that they will allow it to be worn by the user. It would likely be worn on the wrist, but other areas such as the neck are also possibilities along with having it attached to an article of clothing.

The case also includes an area 10 where a strap or other fastening system may be attached. This strap can be easily removed and changed by the user, and may be made of any number of different materials, including those matching the case, plastic, rubber, leather, or other animal or naturally occurring materials. Decorative elements may also be added to the strap or fastening mechanism.

The case, as an option, may also include additional decorations or ornamentations 29, such as gems, jewels, carvings and etching of designs, and other visually and/or aesthetically appealing objects.

Also attached to the case is a user interface, including but not limited to the example buttons 21, 22, 23, and 24. These buttons or a similar interface permit the user to control various functions of the device, along with the options for content display. These buttons may be of various types, including those with a physical movement, or those that are touch sensitive. As an alternative, a touch sensitive crystal may cover the display for customer interaction with the device. The display itself 26 is where the user will view the content.

Figure 3:
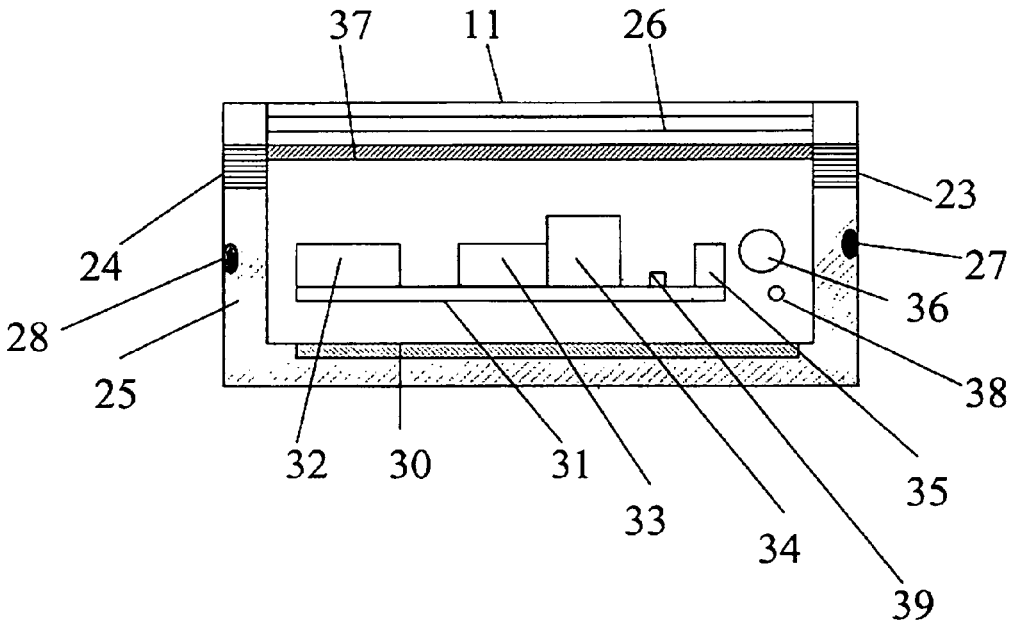
FIG. 3 shows a side view of the internal components of the wearable device.

FIG. 3 shows the main internal elements of the wearable device. The display 26 is capable of rendering color images, including text, pictures, video and animation, and may be based upon any number of electronic display and thin film optic technologies, including but not limited to all classes of liquid crystal displays (LCD), all types of organic or polymeric LCD (OLED or POLED), interferometric modulators (IMOD) and other MEMS related technologies, LCOS, DLP, and digital or electronic ink. Display technologies may be used as directly provided by the manufacturers or modified by downstream suppliers with additional technologies such as brightener enhancers and glare reducers. Display electronics and drivers 37 provide all requisite interfaces to the main motherboard of the device. A protective crystal 11 covers the display 26.

The main board 31 of the device will interface with or contain a number of different components. The main processor 32 will provide overall management of the device and interface to communications options, as well as supply basic memory functions. Additional memory 33 may also optionally be used to store content and device-related files. As an option, the memory or storage configuration may be such that it allows the user to change out the memory, thereby permitting greater storage capability or the installation of new applications. These customer changeable memory or applications approaches provide an alternative means for customizing the device with different themes and types of content.

Various communication interfaces 34 include wireless, USB, Firewire, or any other wired and port interface connections, and the ability to acquire a timing signal over-the-air, along with an infrared port 28. Wireless communication could take place via any number of different wireless technologies and spectrum, including but not limited to SMS, GPRS, GPS global positioning, WCDMA, UMAT, EDGE, MMS, Ethernet, satellite, radio, WIFI, infrared, Bluetooth, paging systems, and unlicensed spectrum, all regardless of the frequency or bandwidth.

The ability to process sound and provide for various audio inputs and outputs 35 is also included, along with a 2-way audio system 27. This system will support voice recognition capabilities. In conjunction with its wired and wireless interfaces, the wearable device will have full 2-way communications capabilities.

A sensor system 39 is provided that can detect motion so that battery power can be conserved during periods when the watch is not in use and so that the display can be changed automatically based upon selected movement of the device, and that can also detect available light so that backlighting or brightness can be automatically adjusted.

A rechargeable and replaceable power storage component 30 powers the personal device. This may be a battery, including but not limited to a traditional type such as Lithium Ion or Lithium Polymer, a fuel cell, sunlight or other sources of light, or any other such power source. These sources could also be used in some combination. As an alternative, some or all of the power supply may be housed in the strap for attaching the device to the user. A small, internal back up battery 36 is also utilized to insure timing and content are retained. A coil/pickup element 38 is included to permit optional wireless recharging.

In another embodiment, multiple displays can be used in the design of the device. In this case two displays are used. Their function may be modified by the user based on any number of different parameters. For example, display 26 may be used to indicate the time while a separate display may be used to indicate the date. In another example display 26 may be used while indoors while a separate display may be used while outdoors or in bright sunlight. The additional display(s) may be located in either the case or any other area related to the device itself, or alternatively may be located in the strap or other related fastening mechanism.

Figure 4:
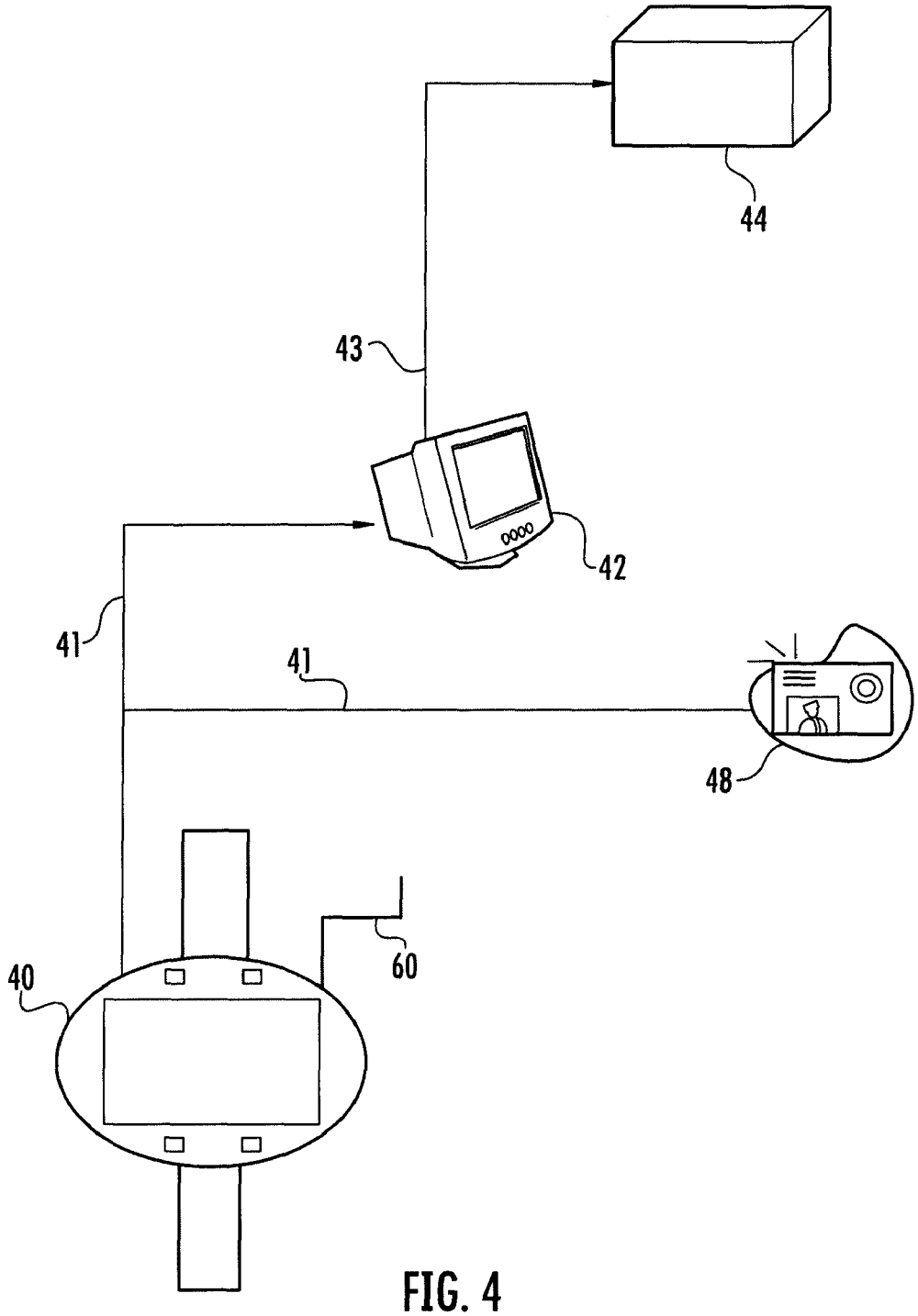
FIG. 4 shows one method of communicating between the wearable device, a personal computer or other device, and the Internet or outside database.

FIG. 4 shows 1 of 2 main interface configuration options. The wearable device 40 may be connected to a number of other consumer devices such as a personal computer 42, camera 48, cell phone, or other item (including data storage media and power sources), via a wireless 60 connection. Alternatively, a direct, wired, or port interface connection 41 may be made from the wearable device to any number of other consumer devices (including a PC, data storage media and power supplies). The personal computer 42, or other similar device, is then connected either wired or wirelessly 43 to an external database 44, including but not limited to the Internet.

Figure 5:
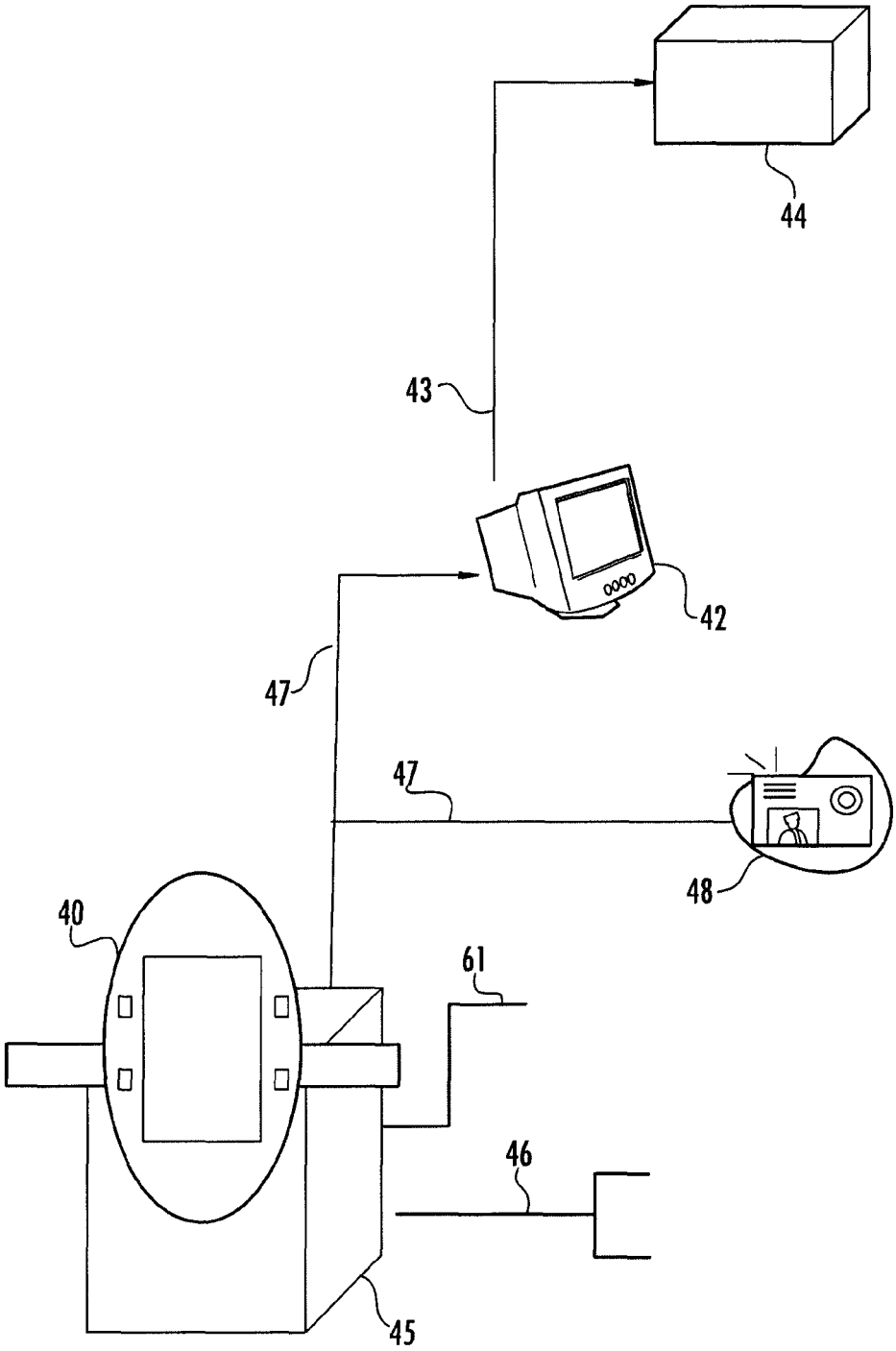
FIG. 5 shows another method of communicating between the wearable device, a personal computer or other device, and the Internet or outside database.

FIG. 5 shows the second main configuration option. In this case the wearable device 40 is connected to an interface cradle or docking station 45. The cradle 45 provides both a method for charging the battery supply, either directly via wall outlet power 46 or over a secondary connection such as USB or other wired connection 47, and a method for communicating with other consumer devices. The method of communicating may either be wireless 61, or a wired connection 47 such as USB. Similar to FIG. 4, FIG. 5 connections can be made to other consumer devices such as a personal computer 42, a camera 48, or a cell phone (or other data storage media and power sources). Other devices such as a personal computer 42 then communicate either wired or wirelessly 43 to an external database 44, including but not limited to the Internet.

As also shown in FIGS. 4 and 5, various additional databases and programs 49 exist to support numerous business management and offer management systems. For example, systems exist that will allow the user to purchase additional dials, content, and personalization tools under various financial arrangements, including but not limited to one time fees and monthly subscriptions. Systems will also track purchases and provide all manner of data outputs to such things as management reporting systems and financial accounting systems.

The cradle or docking station 45 can be made from virtually any type of natural or manmade material, including but not limited to plastic, steel, aluminum, other metals, composites, and wood, and any combinations thereof.

As an alternative to FIGS. 4 and 5 and their range of external communications options, the device may also be provided with more limited or no external communications capabilities. For example, the device may only include the infrared port, or it may lack any communication interfaces. Applications could be limited to those that are supplied by the manufacturer or, as noted above, applications could be changed by replacing memory chips, disks or disk drives, or other related memory-based products. These memory-based products may in turn be customizable and programmable by the user. For example, the memory device may either also fit directly into, attach to, or in any manner communicate with a computer or may interface to a computer via another intermediary device (such as a specialty memory reader that has an interface to a computer).

Figure 6:
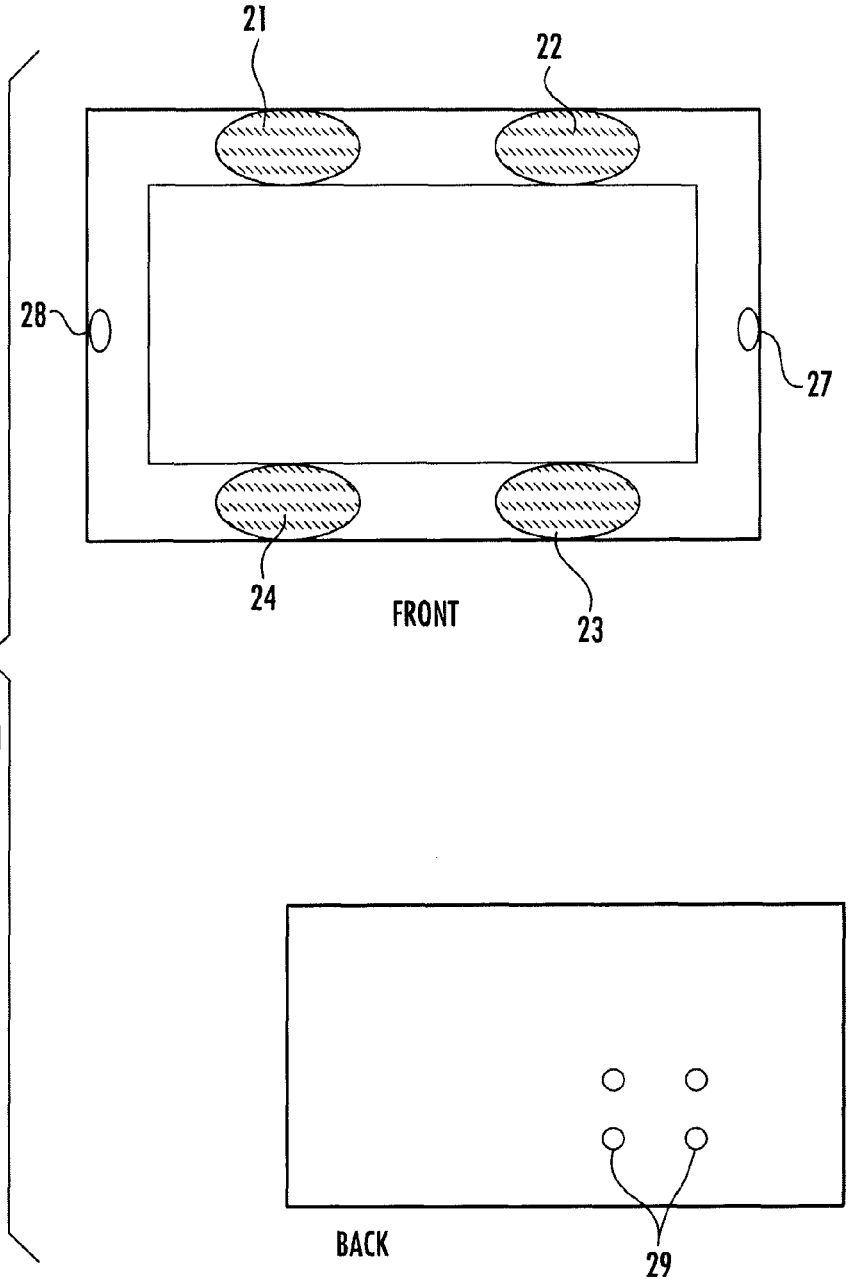
FIG. 6 shows one possible arrangement of the wearable device control and interface buttons, both on the front and rear of the device.

Various user interface options are possible, including buttons, wheels, and touch sensitive components, including screens. FIG. 6 outlines one example based upon user interface buttons. While capable of modification in software, the following is one possible example configuration. Button 21 allows the user immediate access to screen backlighting or brightness adjustment (if applicable to the display technology). It will also allow moving backwards through the menus discussed below. Button 24 brings up the main menu. It also selects an item after it has been highlighted via up or down scrolling by pressing it twice. The main menu provides access to a complete content menu, places to set the time for various functions, activation of alarms, stop watch, and travel modes, and a number of administrative options (such as power saving modes). Buttons 22 and 23 provide for up and down scrolling when pushed after buttons 22, 23, or 24 have been initially selected. When pressed first, button 22 will display a menu listing the top dials or content most frequently desired (these being customer selectable or defined by computer analysis), along with options to revert to the previous, originally displayed dial or to revert to any previously scheduled item. In one sense this is a programmable short cut system. Button 23 has several functions. When in basic operating mode, pushing it once will activate the message retrieval mode, while pressing it twice will provide quick and direct access to a personal electronically engraved sentiment. These messages and sentiments again can be comprised of any variety of content, and can be delivered via text, pictures, video, and other means. It is also noted that further functions of these buttons may be defined based upon the item selected. For example, different combinations of buttons will be used to set the timer or alarm functions and other traditional time-telling applications. Overall, different button combinations will permit the user to have significant control of content and device functions without the need to utilize a PC or other interface device. Menu options will change over time depending upon how the user modifies and customizes his device and based upon new options and content selections.

Figure 7:
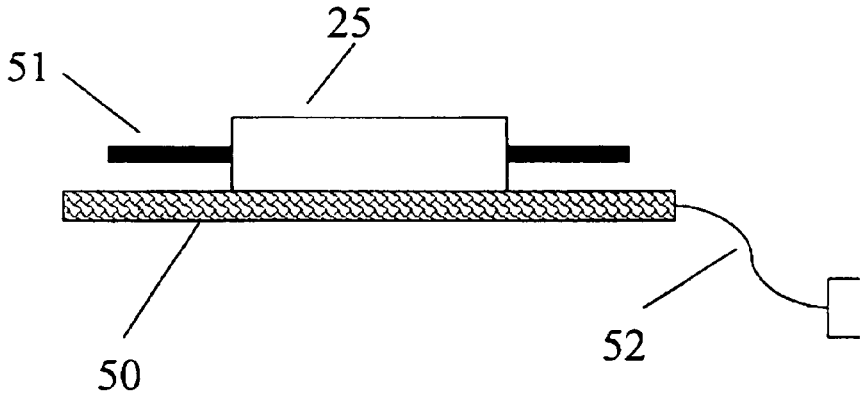
FIG. 7 shows an option for charging the device in a wireless manner. A physical connection to the pad is also possible.

The back view in FIG. 6 shows connectors 29. These connectors provide one form of communication to the cradle 45 and provide a well-sealed and comfortable interface for the user. As an alternative, numerous other types of connectors (such as a 4-pin connector) could be utilized. A standalone version or one using only wireless communications may have no connectors. FIG. 7 shows an optional charging pad configuration and one possible exterior design. The device case 25 (along with the straps 51) is merely laid upon the charging pad 50. This pad is then plugged into the wall 52 for power. The pad charges the device battery 30 wirelessly. Alternatively, the pad could charge the device via the alignment of a physical interface connection, such as the touching of contact points.

The pad itself may be of varying dimensions, materials, and shapes. It may also be composed of different materials, including but not limited to plastic, leather, fabric, rubber, and decorative elements. Multiple materials may be creatively combined in one pad. The pad will contain a circuit board and a connector 53 to a power wall brick. The pad can be plugged into the wall at all times. It may have one or a series of lights and or other indicators that show status such as power on, charging in process, and charging complete.

The electrical principal of the charging pad is well known in electronics and is the basis for all transformers. The charging pad will receive a DC voltage (maybe 12 volt DC or other possibilities) and convert the voltage/current into an AC voltage/current that is applied to a flat circular coil of wire 54. The coil is shaped into concentric circles so that the coil is flat but contains many coil windings. The exact number of windings, the AC voltage and current needed, and the frequency of the AC voltage can be optimized for the device recharging application.

The wearable device contains a smaller but similar coil 38 that is not covered by the metal case 25. The outer area around the coil is made of plastic or another material that will allow the magnetic field to be received. The pad will emit a magnetic field with enough energy to be received by the pick-up coil located in the device. The device receives AC energy from the coil that is converted to a DC voltage that is used to charge the device battery. The charge time is directly proportional to the amount of energy in the magnetic field, and various designs and options are possible. The magnetic field will be sufficient to allow the device to be set on the charging pad in any orientation and still receive enough energy to charge the battery. This is but one possible design. However, one of ordinary skill in the art given the present description and drawings would be able to craft and/or employ other such designs and approaches to accomplish the same purpose and would, therefore, be explicitly a part of the present disclosure.

Figure 8:
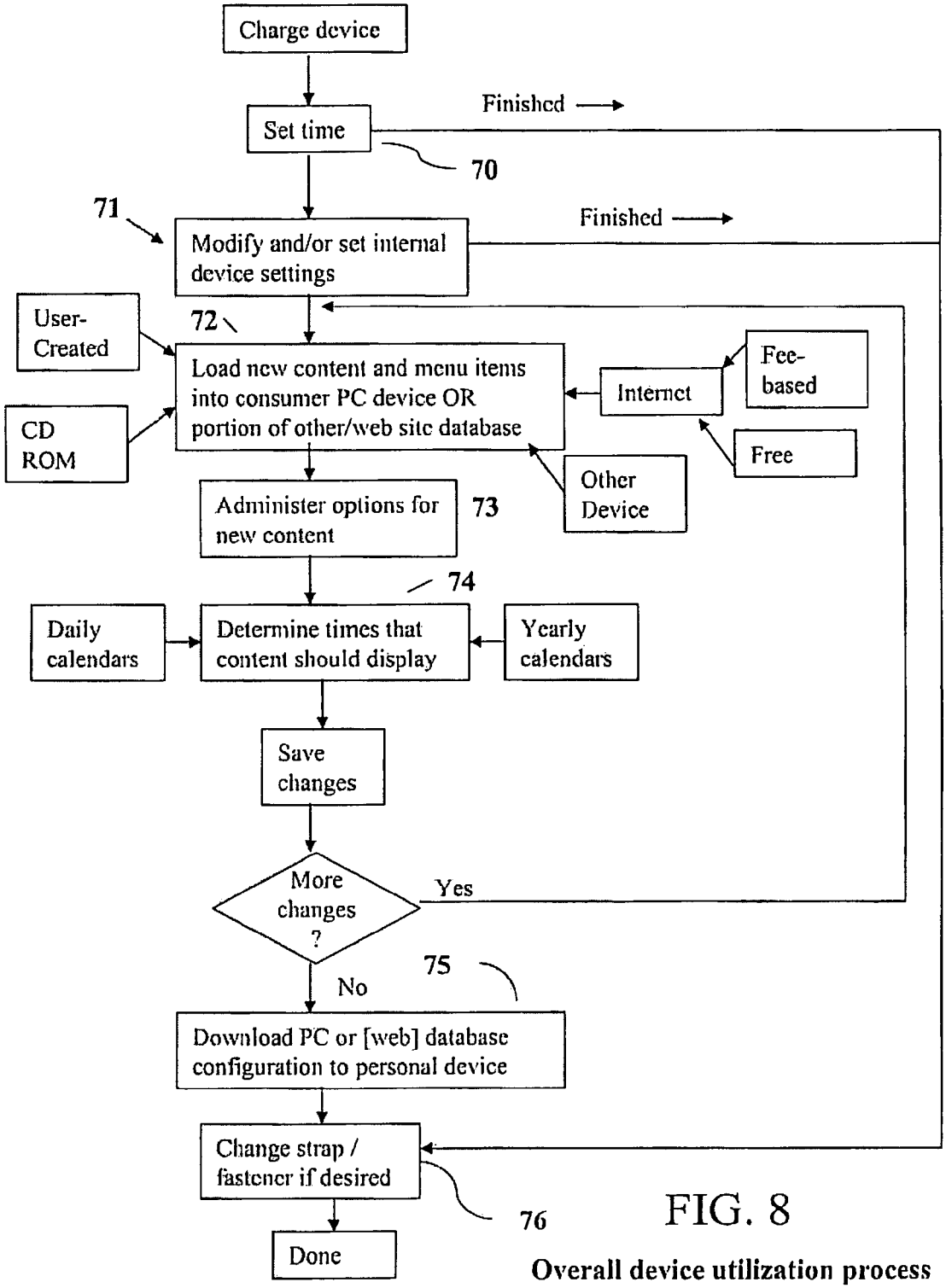
FIG. 8 outlines the overall process for using the device, including programming the device for personalized settings.

FIG. 8 outlines the method for the user to interact with the wearable device. After charging the device, a certain number of time display options and theme content will be available "out of the box." Default settings that manage and administer the device will be pre-set, thus allowing the user to merely set the time 70 and easily use the device. As an option, a simplified menu of operation may be used in lieu of the more complete menu. In addition, customization of the device 71 can be accomplished by modifying the administrative and content settings via the device itself. For example, short cuts to most desired content can be established, travel modes and alarms can be set, different power modes can be utilized, adjustments for different lighting conditions can be programmed, latitude and longitude can be set, and an electronic engraved message can be created. In addition, selected content settings can be activated and adjusted, such as scheduling a specific dial to appear on a certain day, establishing priority or override conditions, or activating a daily messaging feature. These and all manner of other items can be adjusted via the device itself.

In addition, the Internet, other external databases, CD/DVD, a personal computing device (such as a PC) and any and all other manner of content storage 72 may be accessed to acquire additional content and/or manage device settings. This includes utilizing content of the user's own creation, including but not limited to pictures, video, art work, text, sounds, and music. Once the additional content is acquired, it is saved in a personal space, either on the user's PC or in an external database, which as an option may be accessed via the Internet.

Once the content is made available to the user, options 73 relevant to the specific content selected are chosen and saved. Then, as an option 74, the user may choose to utilize a software tool that supports more sophisticated content scheduling functionality. This provides for a further degree of customization. After saving these selections, the content is downloaded to the wearable device 75, the strap or other fastening method may be changed 76, and the process is complete.

Figure 12A:
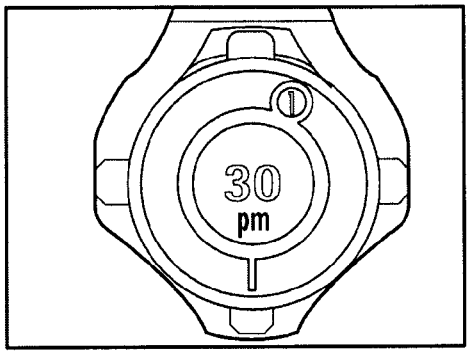
FIGS. 12-22 show example display content.
Figure 12B:
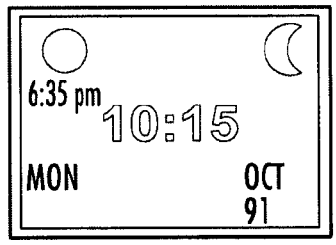
Figure 13:
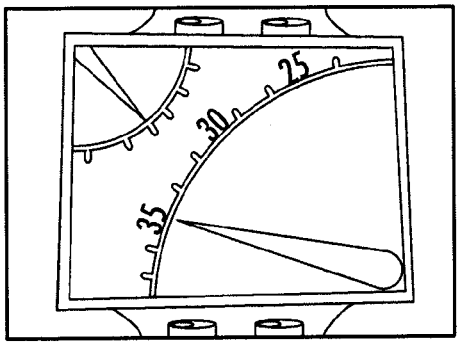
Figure 14:
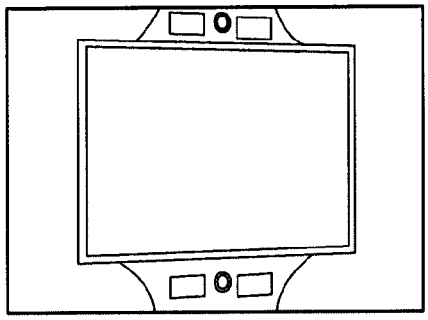
Figure 16:
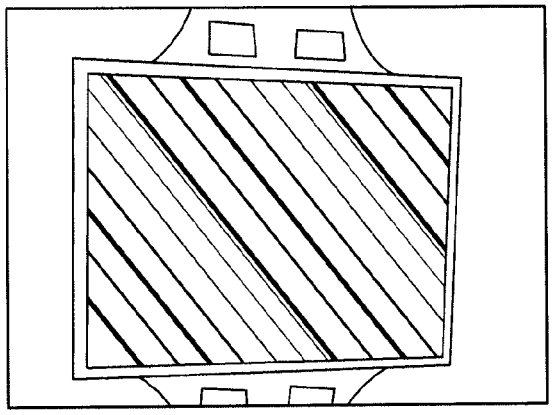
Figure 17A:
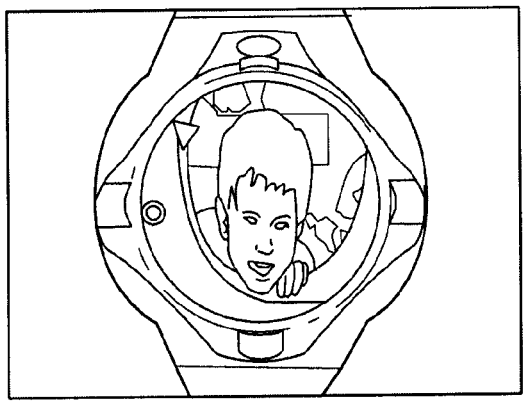
Figure 17B:
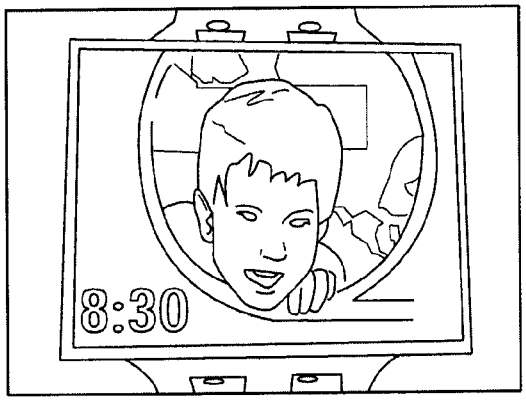
Figure 18:
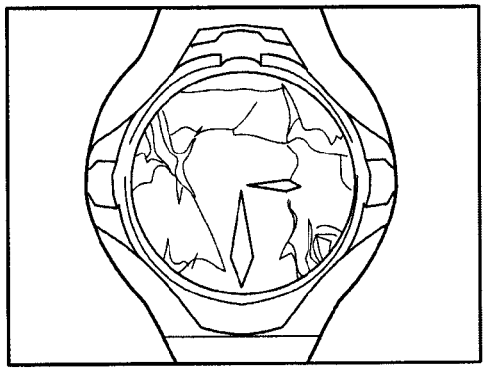
Figure 19:
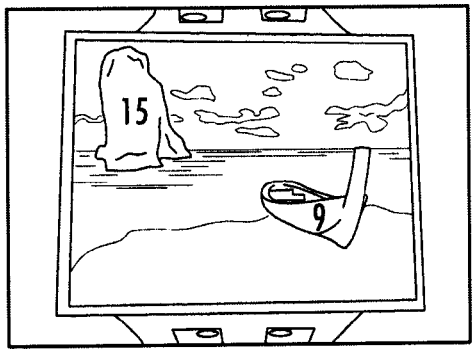
Figure 20:
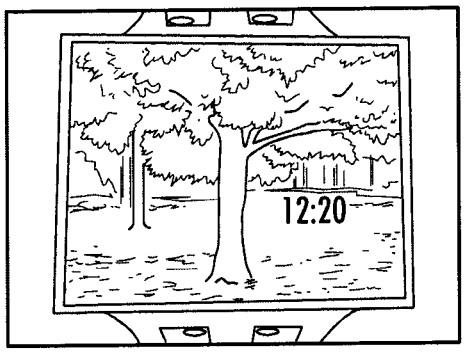
Figure 21:
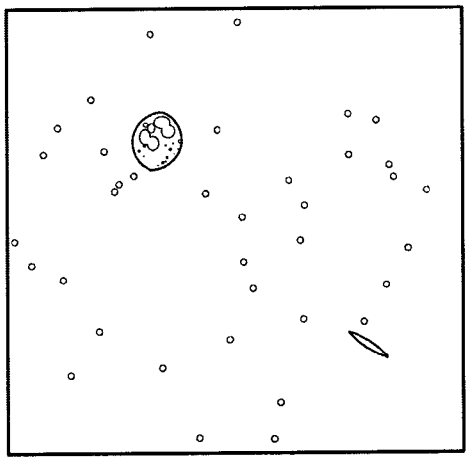

Content that is both initially included with the watch and subsequently acquired may be comprised of any type or combination of audio and images, including text, still images, animation, and video. Various categories of content will be created and expanded over time. Among the categories available will be various types of watch dials, including those created in digital (FIG. 12*a* & *b*), analog (FIG. 13), or art/symbolic (FIGS. 14 and 15*b*) designs; fashion colors (FIG. 16); pictures or other various personally designed or created items (FIGS. 17*a* and 17*b*); themes (FIGS. 18 and 19); seasons or holidays (FIG. 20); statements or messages; day to night sky transformation at sunset (and vice versa; FIG. 21) along with an accurate portrayal of astronomical events such as the night sky, moon phase, meteor showers, and eclipses; lists and reminders; and entertainment. It should be noted that themed content could be from almost any topical area, including but not limited to sports, music, art, religion, philosophy, motivation, history, politics, the Earth, nature, birds, animals, geography, cities, museums, cultures, and science. It may also include personal content owned by the user.

Figure 15:
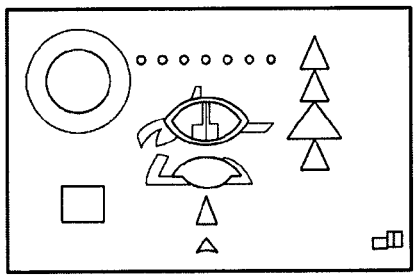
Figure 22:
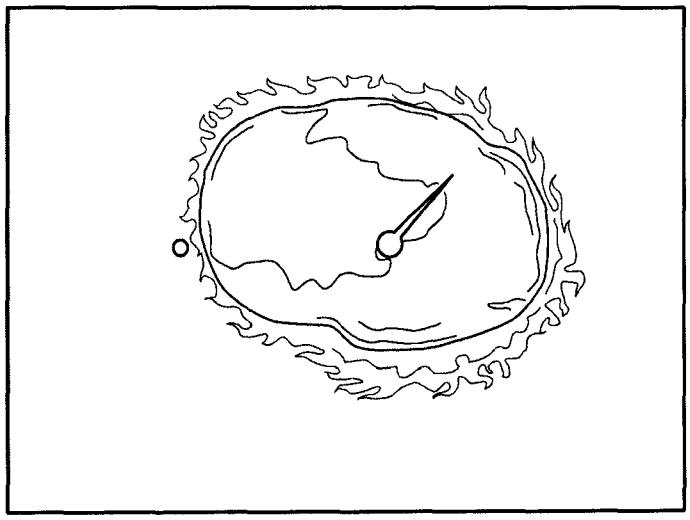

The purpose of the content can be to display time, inform, enlighten, entertain, create and reinforce a theme for the device, or communicate and indicate some aspect of the user's personal interests or brand. The content itself can be a method for communicating the time. For example, time can be woven into the image being displayed either by a simple overlay, by integrating and embedding it into the activity or action being displayed, or by the addition of symbols. As briefly referred to above, FIG. 15 shows how color display technology will be used to show time in symbolic ways that are unusual or non obvious at first glance. For example, a combination of unique symbols, woven into art and set in motion, will be used to communicate both a sense of fashion and style, as well as the time. As also referred to above, time itself can be embedded into the action of the image itself. For example in FIG. 22, the light ray emanating from a star can move and indicate time, along with the motion of another star. In another example of this approach, a bird theme could be used. A bird may fly across the screen in 1-minute increments, thereby marking the passage of the seconds. Or, a particular species may appear and take some action on the hour, marking the change of the hour. Thus any aspect of the passage of time (such as seconds, minutes, hours, days, months, season, etc.) can be customized by the user with content derived from theme(s) of the users choosing, which in turn may have special meaning only to the unique user who created such content.

Entertainment may take the form of a game or a quiz, such as "What event happened at this time on this date?" Lists and reminders could include anything the user wanted to create and store in the device, up to and including appointments. Any type of audio and graphical/image content can be scheduled to appear with lists, appointments, and reminders. Calendar events can be transferred from other devices via the various communication methods provided. For example, appointment data in a personal digital assistant (PDA) could be transferred to or synchronized with the wearable device.

Figure 9:
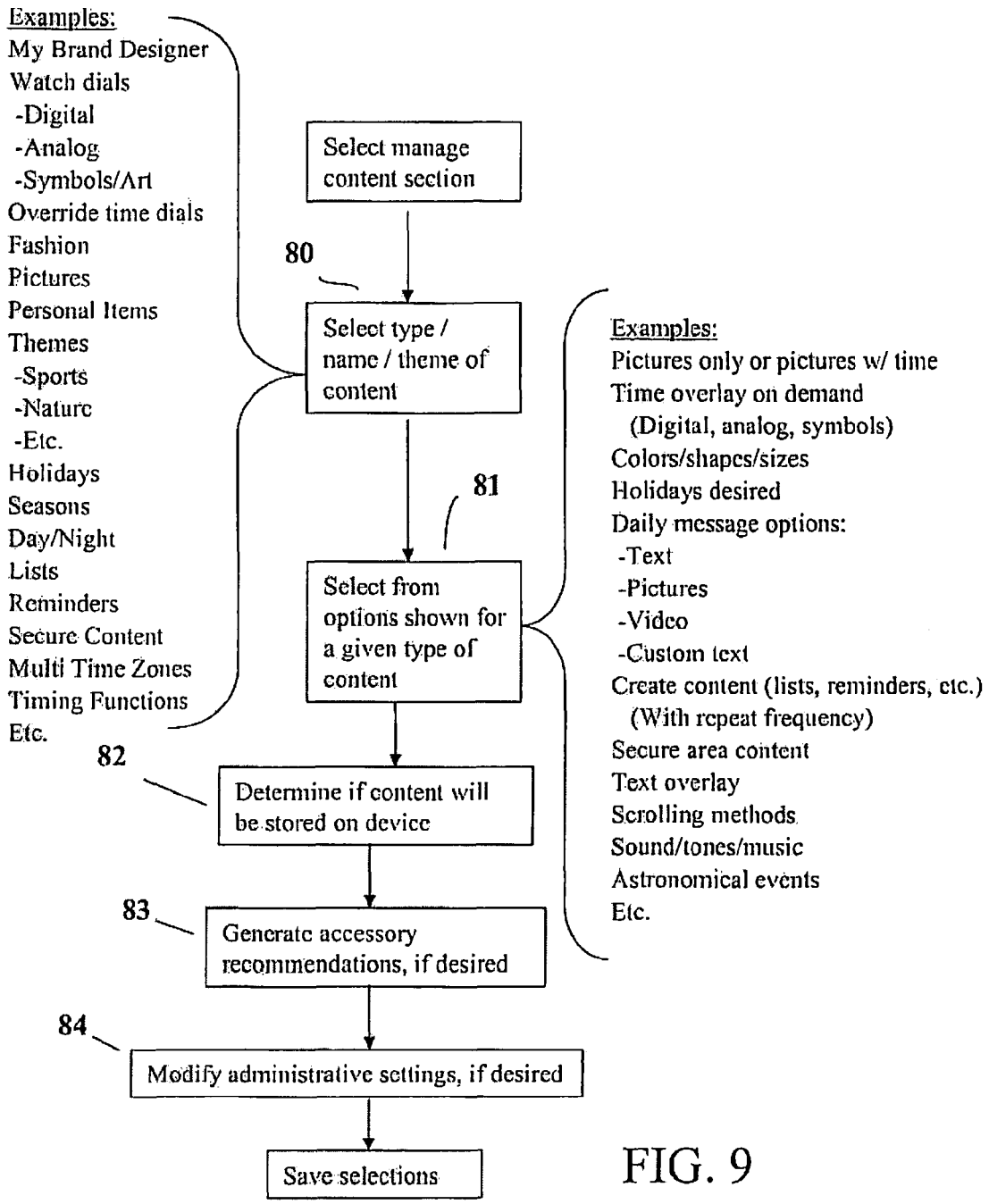
FIG. 9 outlines the options involved for administering the content selections from a PC or similar system.

FIG. 9 provides an overview of the supplemental or more advanced content management process 73 that is available via a PC or other similar system. Options available for customization with this additional content may exceed those available with the content that is provided with and adjustable on the device itself. A category of content 80 is selected from a list. As an option, during content selection 80, a user will be able to interact with an application that will make content and accessories (such as straps) recommendations based upon a user's personal profile. This profile will elicit insights on the user's interests, wants, preferences, and personality, and based upon this insight, create a highly customized and unique personal-branded wearable device.

Each item of content will have its own unique set of customization elements 81. The user will select those aspects of the content that most appeal to him or her. For example, if a text image is part of the content, should it be scrolled across the screen or displayed in a complete block? Will the text image be displayed continuously, or will it cycle off and on, and if so, in what manner? Will a notification be made prior to the text image appearing, and if so, in what way? If a picture is to be displayed, how should the time be displayed? On demand only? Over the image shown? If a particular digital time display is chosen, what colors are desired and what shapes should be used to also mark the time? If sounds or music are to be played, at what times and under what circumstances? The user will be able to address all relevant options for a given style of content.

Once selected, the user will decide if the content should be made available to the device 82 and if system-generated accessory recommendations 83 are desired. After saving selections, other content themes can be similarly addressed if desired. All other watch functions 84, including administrative and system details, can be managed and modified via a supplemental system such as a PC as well.

Traditional timekeeping applications will be available to the user as part of the initial device content as well as via later additions. These would include functions such as alarm, chronograph, timer, and multiple time zone display. These functions can be integrated into the vast array of other device capabilities. For example, new or customized content could be displayed upon activation of an alarm or be associated with arrival in a new time zone.

Figure 10:
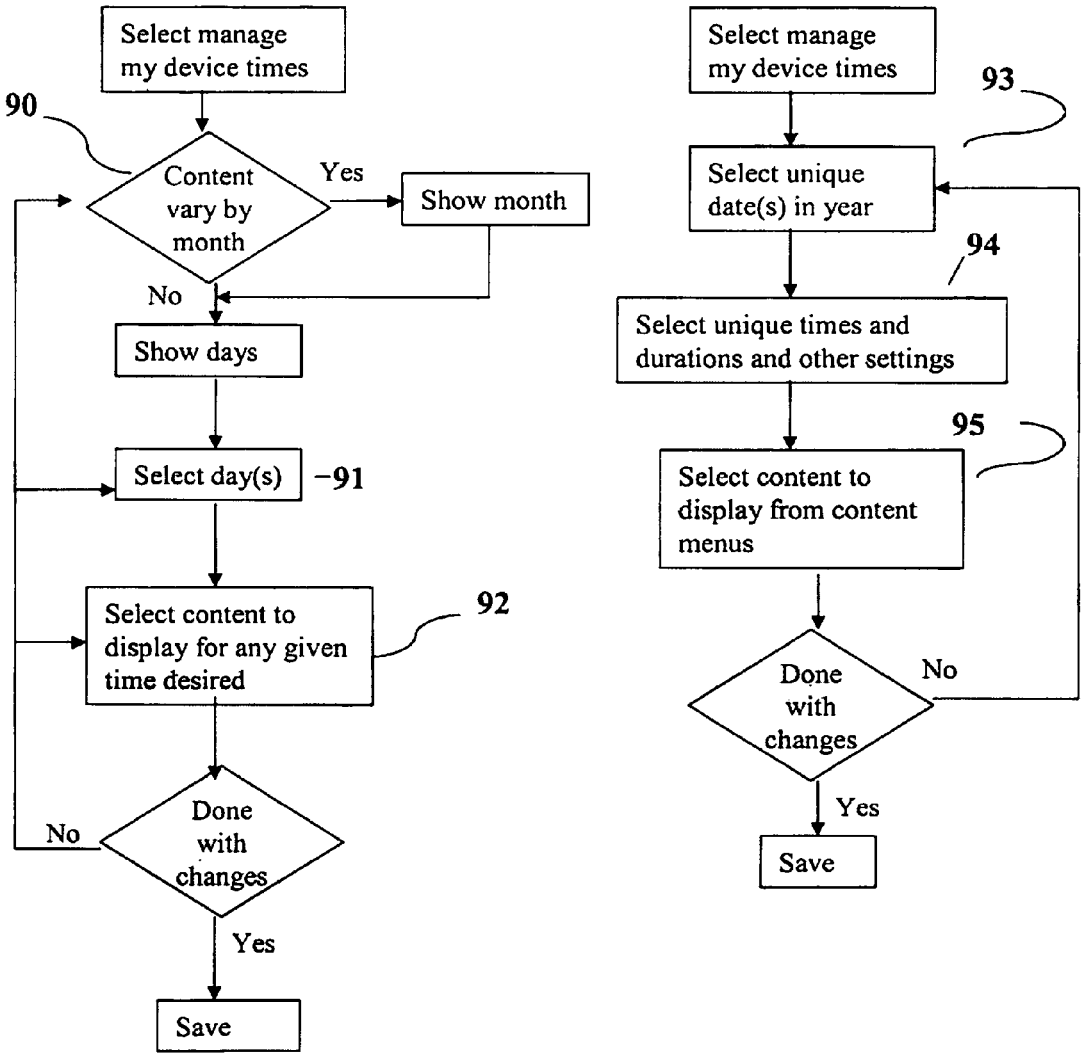
FIG. 10 outlines the process for using a PC or similar system for more sophisticated scheduling options.

In addition, a secure, password or biometrically protected area will exist in the device where sensitive content may be stored. Use of the password or biometric data will be required to retrieve the content. Content would include such items as passwords, login ID's, security clearance codes, airline and credit card account numbers, special members only numbers, sensitive personal information, and bank and financial institution accounts and records. FIG. 10 outlines a method for programming, via a PC or similar system, selected content to be displayed at predetermined times of the users choosing. This level of flexibility will exceed that available on the device itself. Users will decide 90 whether to vary the displayed content by month of the year. They will then decide 91 whether content should vary by days of the week, such as Monday through Friday as a block versus Saturday or Sunday. After making these types of determinations, the user will identify different content 92 that will display at selected times. For example, a basic dial display showing time in a given symbol format may occur in the morning, but from noon to 1 pm a type of sports content will be displayed.

In addition, a capability 93 exists that permits the user to select a given individual date and time to display content. The unique date 93 and time 94 is first selected, and then content 95 is chosen to be displayed. Content in both 90 and 93 can be of any type, including factory supplied, later supplied content, or a user's own content, including personal reminders, appointments, and other various messages. Various options for methods of displaying the content will be possible. For example, a picture of a family member may be selected to display upon that person's birthday. The picture may be displayed for 5 minutes every hour on the hour, or may be displayed constantly from 4 pm-8 pm. This concept is referred to as "electronic engraving," and allows personalized content to be created and displayed at unique times or "on demand." Or, For example, content unique to July $4^{th}$ may be selected to appear on that day only. It will appear for 5 minutes on every hour. It will continue to display the time in a digital format while an animated theme related to the $4^{th}$ of July appears. In yet another simple example, a school logo would be set to appear only on selected sport game days. Time would be optionally displayed via a traditional watch hands representation and the school song would be output 5 minutes before the scheduled start of the game.

Figure 11:
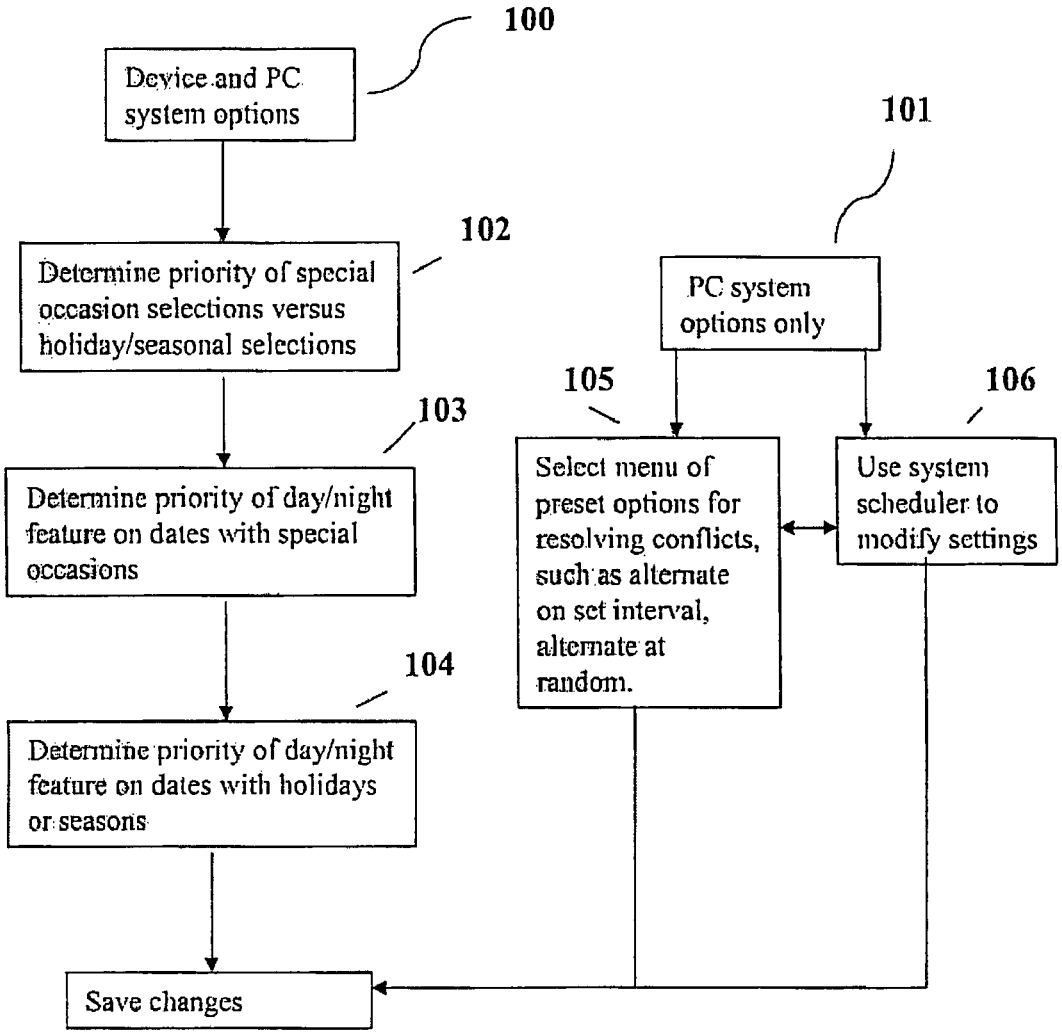
FIG. 11 outlines the options that can be used to resolve potential content scheduling conflicts.

FIG. 11 outlines example additional scheduling resolution options that will be available both from the watch and from the supplemental content management and scheduling system 100 and from the supplemental PC-based system only 101. Here the user will be permitted to select among options for resolving possible scheduling conflicts. For example, special occasion content (such as a birthday or school sporting event) could be desired on a given day. That day could happen to coincide with the first day of Fall. This day could also be a weekend day when certain content has been previously scheduled to always appear on the weekend. Lastly, a different dial could have previously been selected to appear at nighttime at a certain time every day. Making selections of content from the device itself creates fewer types of potential conflicts. These conflicts can be resolved via several simple yes or no questions 102-104 that can be answered on the device. More elaborate options for resolution of these and other types of conflicts will be possible via the PC or similar system. For example, a user may wish to set up a schedule 105 where the content items in question can alternate throughout the day in either a regular pattern or at random. Or the advanced scheduler function 106 may be used to select specific times for specific types of content.

Once all scheduling parameters have been set and saved, the user can easily cancel them via a device menu selection or via the more advanced PC system. Options to cancel the more advanced PC-generated parameters while retaining those set on the device along with cancelling all scheduled items will be available. Other ease-of-use designs related to the product are also considered part of the overall invention.

Numerous modifications may be made to this invention without departing from its scope as defined.

Furthermore, along with the core functions of the device described herein, other related functions can be provided. This is made possible in part by the vast communication, processing, and storage capabilities of the device. Other applications are described below.

The time related display content, or other content, may also be used in a stationary frame, such as could be kept on a desk, shelf, table, or mounted on a wall.

Voice and command recognition will be part of the device capability such that changes to the display and settings can be made via verbal communications.

The watch acts as a wireless credit card. The watch can merely be held up to a scanner, reader, or other device and can be used to pay for items purchased. This function can optionally be used in conjunction with other security and biometric capabilities of the watch such that the purchasing function can only be used by an authorized individual.

The display and computer module can be of such a design and configuration that the entire display and internal device components can be easily removed and inserted into a different case. This allows the user to purchase one working module and insert it into various cases or housings. The inclusion of scanner capabilities. This scanner will support a number of applications. These include but are not limited to scanning a fabric or other item to coordinate the device display with another fashion or personal item; scanning a fingerprint, eye, or other unique personal attribute for purposes of identification and/or security; and scanning an element of text or an image. The inclusion of camera and video image capturing capabilities. The device can record either still or video images directly and either incorporate them into device themes and applications or output them to other devices.

By communicating with a sensor either in or on the human body, or integrated into the wearable device itself, in a manner that would be apparent to one skilled in the art given the present description, a variety of information and analyses can be displayed on the wearable device. Any organ or element of the body could be part of the monitoring plan, including but not limited to blood chemistry, hormone levels, and brain wave activity. Among the indicators presented to the wearer would be: calculations of peak mental and physical performances times throughout the day; suggestions for when additional rest is needed; display of any number of body monitoring and measurement results (for example blood pressure or levels of certain substances and medications in the blood); indications of peak fertility times; and an interpretation of emotional state. Outputs from the device may vary, including: transmission of medical results to another location (including a physician); instructions to an implanted device to secrete a certain dosage of medication or to take some other action; the display of colors or graphical and video types of information that convey the item measured (such as a color a user associates with elevated blood pressure or the graphing of personal stress levels); and a text or audio message to the wearer that communicates results and analyses (such as "Your blood pressure has elevated to high levels 3 times today at the following times, all of which correlated to meetings regarding a given topic"; or "It has been over 10 days since your heart rate has been elevated for 15 consecutive minutes. Please increase exercise program" or "Your blood has dropped below its optimum level of B12."). The device may also display colors or designs that are associated with a current mood or emotion. An individual's overall state of physical or emotional health could be displayed in new ways, along with interpretations of the data. Recommendations could also be made about whether this is a good time to make a big decision or other important insights.

In conjunction with the medical analysis capability, relevant music or sounds can be played at selected times to provide some benefit to the wearer. For example, if stress is sensed, certain music can be output.

Also in conjunction with medical monitoring, if the wearable device detects a serious medical condition, it will be capable of automatically recalling important medical information for immediate display (such as lists of current medical conditions, history, and allergies) and under certain conditions automatically dialing a 911-like emergency number and reporting the user's exact location. An emergency signal can also be manually initiated.

All of the above capabilities will contribute to revolutionary changes in how medicine is practiced. Doctors can receive important medical data before a patient arrives for an appointment, saving time and reducing the need for follow up visits and phone calls. More routine cases can be screened and handled in automated or semi automated processes, reducing the need to even visit a doctor's office for basic care. Doctors can thus spend greater time on more critical cases and on conducting research.

The wearable device will also, via its communications, processing, and battery power capabilities, among others, be able to provide critical support to artificial limbs, organs, and implanted devices whose role is to support or enhance an existing part of the body. For example, working in conjunction with a system implanted to work with the vision sensing process of the body, the wearable device could provide important signal processing and storage capacity necessary to help improve the sight of a blind or visually impaired individual. Or, the wearable device may provide for the operational support of an artificial limb. The wearable device may be capable of communicating with the human brain in some aspect of it performing any or all of these functions.

The wearable device will also be a link to home security systems, whether a user is at home or away from home. The device will notify the user of alarms or possible significant situations requiring immediate attention (such as a water leak in a basement). It will also communicate with child monitoring devices that are either stationary (such as in a nursery) or being worn by a child. Any situation requiring attention can be displayed on the wearable device. This would include the ability to track a child's physical location and note any discrepancies from the norm.

An ability to input sound can warn the wearer of being exposed to excessive levels of noise pollution with resultant possible negative effects. It can also monitor the sound of the users voice for signs of stress and other emotional issues.

In conjunction with monitoring individual biological data, the wearable device can interface to security systems, allowing access to secure or sensitive areas with an added level of ease and security.

The device will be able to receive all types of emergency notifications. These could include weather, crime, biological, disease, and terrorist alerts. Lesser alerts could also be provided, such as for high UV exposure, air pollution, or pollens, many of which have significant health impacts for consumers. Alerts for traffic congestion, accidents, and delayed carrier schedules would also be made available. Many of these environmental data could be communicated to the device from a central location. Alternatively, as one skilled in the art could appreciate, the user's local environment could be measured by sensors located within the device itself.

The device will communicate with various home appliances. For example, a user may have put something in to cook before leaving the house, and getting an automatic notification and reminder whether at or away from home will add convenience and safety. Or, a walk past a refrigerator will update the wearable device automatically with a list of items that need replenishment. Merely walking into a room can automatically activate lights and other helpful appliances. In addition, doors can be opened, closed, and locked from the device. Interaction can also take place with a household entertainment system. For example, either menus and buttons or spoken voice commands could be used by the device to modify music selections playing through a household's distributed entertainment system.

Communication with a user's car is also supported. A user will be notified if someone attempts to enter his vehicle while the security system is active. Reminders for service will also be communicated from the car to the device and will be accumulated there, making the next trip in for service more efficient and productive.

By utilizing both its receive and transmit communication capabilities, the wearable device will be able to respond to voice commands for information. Just ask for a movie time or phone number and it appears within seconds on the device. It thus behaves almost like a wearable crystal ball. Utilizing the 2-way communications capability, the wearable device can also be used to control and or communicate with any type of robotic device. Verbal instructions or pressing buttons could be used as part of the communications process. For example, a home cleaning robot could be summoned to a particular location to vacuum up something that was spilled or to deliver a meal. A robotic pet animal may also be similarly controlled.

Music, video, and other large data records can be stored in the device. They can be acquired via either wired connection or wirelessly downloaded. The music, video, or other content can be utilized by itself or integrated into the time telling function in any manner chosen by the user.

Based upon its multiple input communications capabilities, including but not limited to button press, voice recognition, and a screen capable of recognizing writing and other symbols, the wearable device will be able to compose and generate music. For example, if the user would like a particular tune or melody to play at any given time, that tune could be sung and recorded by the device, or alternatively, the actual musical notes could be input to the device which will then be translated and composed into the melody desired.

Retail outlets will communicate various types of information to the user of the wearable device. For example, upon entering a given establishment, the user can be sent a range of applications, such as promotional discounts and information on new products that match a profile (such as recent purchases or known preferences). The store could also pass inventory information to the wearable device from tags or labels attached to the inventory itself. This type of information could include not only prices but also information on low stock or "last one available in your size" type of insight. Or, a recipe can be provided unobtrusively to patrons of a restaurant upon their visit; a city could provide updated information on park events to those visiting the park.

The ability to borrow material and then save it for subsequent display or playback will also be supported by the device. For example, after entering a library a user finds a book and magazine of interest. The user checks out the material to the wearable device whereupon it remains available for a set period of time. The user is then free to either read or listen to the content that was borrowed at the library until it has "expired". The processor will support translating text into audio for this as well as other applications. The wearable device can also communicate the content to another device, such as an electronic book.

Materials such as books, music, and video can be purchased in any manner and then stored for listening to, watching, or reading at any time. For example, after browsing at a bookstore, a user may purchase a book by having it transmitted to the wearable device for later retrieval. The item purchased may also then be forwarded to another device such as an electronic book or computer.

The wearable device may act as a front-end display to other devices such as a cell phone or PDA, among others. The device will display notification information for example, such as caller ID, email arrival from important contacts, or receipt of voice mail. The user can thus screen information productively, and make decisions accordingly. Also, in conjunction with the aforementioned medical capabilities, the device will recommend and coordinate scheduling of meetings that will maximize the group's performance based upon analysis of the other participants' biological and mental peak performance profiles.

In addition, the wearable device can serve as a full voice and data wireless product while retaining its core time-telling and other functions as described herein. Dialing can be done either via voice command or use of the device buttons. Memory can be used to store any type of data content and files. Real time information can be received on the device, such as news and sports scores. The device can support 2-way communication via its sound output capability and its wireless technology interfaces. This includes but is not limited to communication to a related product that works in concert with the main device, such as an earpiece or a speakerphone embedded in glasses or an earring. Voice recognition capability can turn spoken words into text and vice versa. As an example application, a student could transmit class notes to the wearable device and have them read back to him or her while exercising.

In conjunction with its global positioning capability, the device will provide information and consultation on various aspects useful to the user. Many of these will again be linked to the concept of time. For example, is the user spending more than a predetermined ideal amount of time at work? If blood pressure has been rising, in what locations has that been observed? Messages can be displayed along with helpful suggestions. In addition, the wearable device will be capable of communicating with other devices as the user travels around, thus delivering a wide range of useful information. In conjunction with GPS or other networking technologies, a favorite store could provide coupons and other information when you were known to be within a certain range of that particular store. Information can also be automatically recalled and displayed based on a situation or location. For example, perhaps the user enters a bowling alley. The user's most recent and highest score from that or any other bowling alley would be automatically displayed with no intervention whatsoever by the user. Or, the user is walking through a particular store and is automatically reminded that a family member's birthday will be in 2 weeks and that the person is known to like a particular type of item from this store. Also, the location-based capability will help a person be found if they are lost or confused, such as with a certain medical condition.

The device will also be able to assist the wearer in locating items that are lost or stolen. For example, it may help in the locating of a golf ball while playing golf, or with the location of a stolen purse.

The replacement of credit cards will also be possible with the wearable device. The device could be scanned or communicate wirelessly to another device, eliminating the need to carry credit cards. Security for the usage of the device could include reliance upon biometric and biomedical information either stored in the device or in or on the wearer himself, or in a separate system or device, thereby assuring that the device could only be used when worn by the appropriate individual.

The wearable device can also be used for playing games that are hosted remotely. This includes games of chance where legal betting is involved and state-sponsored lotteries.

The wearable device will communicate with or appear to be interpreting communications with animals, such as a dog or cat, spirits, or alien beings, including either perceived real identities or programmed or robotic identities of the same.

Upon receipt of information such as weather forecasts, the wearable device could modify its information display and perhaps override certain preprogrammed content.

The device can notify you when others who match a predetermined profile are in the vicinity.

The user is able to listen to or watch broadcasts of any type of over-the-air programming, and store selected programs for use at a later time. This information will be available to the wearer for creatively injecting into the programming of how time itself will be portrayed. Broadcast information can also be received with data on any subject, stored for retrieval, and displayed with a number of optional content selections. For example, a sports score could be shown with a school logo and song simultaneously being displayed, all at a predefined time.

Device straps and other fasteners that are interchangeable will be created to carry different scents. These scents can be changed in whatever manner the user chooses. Or, based on the functionality described herein, the user may be given recommendations by the device for scents that will best address a number of medical or emotional conditions. A range of aromatherapy straps for the wearable device will thus work in concert with all other aspects of the device.

The wearable device will communicate with any number of other devices, among them a wireless earpiece. This earpiece may be of any size or shape, including such design as to be so small as to be unnoticeable, or alternatively may be implemented into the ear itself. The device will also be able to communicate with glasses, goggles, or other such items as may be worn over or near the eyes in order to provide for additional visual display capabilities. Via wired or wireless communications capabilities, the device will also communicate with other pieces of jewelry, wearable art or electronics, and other electronic devices that may be carried on or near the body. The device can also serve as a master controller or integrator of information from these other various devices. In the case of jewelry for example, a bracelet with display capabilities may be communicated with in order to update or modify the items and colors being shown on the bracelet. An entire assortment of similar items may be managed and controlled by the main device referred to herein. These ancillary items may also be controlled and managed by the more sophisticated PC or similar advanced system.

The device will be capable of acting as a voice recorder, or be able to record the conversation taking place in the nearby vicinity. For example, students can record lectures for retrieval at a latter date.

The ability to graphically and informatively display an image tied to any and all of the above is provided. For example, if a refrigerator noticed the need to replenish certain items, a picture of a refrigerator would appear at appropriate times to help the user visualize the needed action to be taken.

The invention claimed is:

1. An apparatus, comprising:

a wrist watch comprising;

a strap that is sized and shaped to be disposable about the wrist of a user;

a case connected to the strap;

at least one display supported by the case, and selectively displaying text, video, pictures, and animation;

a processor supported by the case, for storing a plurality of content images indicative of different thematic representations of time and dials and for providing signals to the display to cause the display to visually represent the time and dials based upon the thematic representation set forth in the content images;

means for determining the location of the wrist watch and providing data to the processor indicative of the location of the wrist watch, wherein the processor is adapted to determine a time of sunset and a time of sunrise based on the location of the wrist watch, wherein the processor is adapted to automatically change the thematic representation of time displayed on the wrist watch based on the location of the user, and wherein the processor is further adapted to automatically change the thematic representation of time displayed on the wrist watch at the time of sunset and at the time of sunrise;

means for determining ambient light, wherein the processor automatically adjusts a brightness of the display in response to changes in ambient light;

a user interface, supported by the case and communicating with the processor, the user interface has a user interface activator that upon actuation, provides at least one user command to the processor to cause the processor to retrieve one of the content images and to output signals to the display to cause the display to visually represent the time and dials based upon the thematic representation of the content image wherein the user interface enables user-customization of the content images and dials by transmitting user commands to the processor;

a power storage component supported by the case and supplying power to the processor, user interface, and the display; and an external computer detached from the wrist watch, the external computer providing content images indicative of the thematic representation of the time and dials to be stored by the processor.

2. The apparatus of claim 1, wherein the processor has administrative settings and receives user commands to customize the administrative settings.

3. The apparatus of claim 1, wherein the processor modifies the manner in which the content image is provided to the display via user command.

4. The apparatus of claim 1, wherein the external computer modifies the manner in which the content image is provided to the processor based on user command.

5. The apparatus of claim 1, further comprising a charging pad including a circuit board and connector for a power wall brick, the charging pad supplying power to the power storage component when the wrist watch is disconnected from the wrist of the user.

6. The apparatus of claim 5, wherein the charging pad supplies power to the power storage component through inductive coupling.

7. The apparatus of claim 1, further comprising a sensor system supported by the case and controlling the power supplied by the power storage component to the display, such that selective movement of the wrist watch adjusts power supplied to the display.

8. The apparatus of claim 1, wherein the processor stores an electronic engraved message.

9. The apparatus of claim 8, wherein the electronic engraved message is programmed using user-personal content.

10. The apparatus of claim 8, wherein the electronic engraved message is accessible via a single touch button on the user interface.

11. The apparatus of claim 1, wherein the external computer modifies the manner in which content images and dials are visually represented.

12. The apparatus of claim 11, wherein the processor provides administrative settings customized via the external computer.

13. The apparatus of claim 1, wherein the content images are user-personal content images.

* * * * *